US005194902A

United States Patent [19]

Kamimura et al.

[11] Patent Number: 5,194,902

[45] Date of Patent: Mar. 16, 1993

[54] TRANSFER UNIT

[75] Inventors: Taisuke Kamimura, Nara; Yasutaka Maeda, Ikoma; Hideyuki Nishimura, Yamatokoriyama; Tsuyoshi Miyamoto, Osaka; Yukihiko Ueno, Hirakata, all of Japan

[73] Assignee: Sharp Kabushiki Kaisha, Japan

[21] Appl. No.: 349,994

[22] Filed: May 10, 1989

[30] Foreign Application Priority Data

May 16, 1988 [JP] Japan ..... 63-119003
May 16, 1988 [JP] Japan ..... 63-119006

[51] Int. Cl.[5] ..... G03G 15/14

[52] U.S. Cl. ..... 355/277; 355/271; 355/273

[58] Field of Search ..... 355/277, 281, 283, 273, 355/274, 275, 271; 430/126

[56] References Cited

U.S. PATENT DOCUMENTS

| | | | |
|---|---|---|---|
| 3,854,974 | 12/1974 | Sato et al. | 355/277 X |
| 3,932,035 | 1/1976 | Sato et al. | 355/277 X |
| 3,947,113 | 3/1976 | Buchan et al. | 430/126 X |
| 3,993,021 | 11/1976 | Kline | 355/271 X |
| 4,049,343 | 9/1977 | Hermanson | 355/257 |
| 4,056,314 | 11/1977 | Silverberg | 355/256 |
| 4,068,937 | 1/1978 | Willemse et al. | 355/277 X |
| 4,076,405 | 2/1978 | Silverberg | 355/256 |
| 4,106,868 | 8/1978 | Ophey | 355/271 X |
| 4,410,260 | 10/1983 | Kuehnle | 355/277 X |
| 4,477,176 | 10/1984 | Russel | 355/271 X |
| 4,514,078 | 4/1985 | Béduchard | 355/277 |
| 4,541,709 | 9/1985 | Kampschreur | 355/271 |
| 4,595,274 | 6/1986 | Sakurai | 355/290 |
| 4,708,460 | 11/1987 | Langdon | 430/126 X |
| 4,743,939 | 5/1988 | Dulmage et al. | 355/274 |
| 4,772,918 | 9/1988 | Karasawa et al. | 355/274 |
| 4,931,839 | 6/1990 | Tompkins et al. | 355/277 |

FOREIGN PATENT DOCUMENTS

| | | | |
|---|---|---|---|
| 0332223 | 9/1989 | European Pat. Off. | 355/274 |

*Primary Examiner*—A. T. Grimley
*Assistant Examiner*—Matthew S. Smith

[57] ABSTRACT

A transfer unit including: a transfer belt onto which toner images are formed; a backup roller on which said transfer belt is applied, the metallic surface of said backup roller being coated with a dielectric film; a metallic transfer roller that is disposed opposite to said backup roller across said transfer belt and to which a predetermined transfer voltage is applied, said transfer roller pressing copy paper against said backup roller with said transfer belt placed therebetween so that said toner images formed on said transfer belt are transferred onto said copy paper to be transported between said transfer roller and said transfer belt; and a back plate that is located in the vicinity of said backup roller and that contacts the back surface of said transfer belt, whereby an electric field for transferring a toner image by a low transfer voltage can be created, thereby preventing the transfer belt from dielectric breakdown.

2 Claims, 2 Drawing Sheets

TRANSFER UNIT

BACKGROUND OF THE INVENTION

1. Field of the Invention

This invention relates to a transfer unit for a full color copying machine.

2. Description of the Prior Art

Generally, in a full color copying machine, three separate images are formed on a photoconductor belt by the use of toner of three primary colors, yellow, magenta, and cyan. The toner images are transferred onto copy paper by means of a transfer unit. The transfer unit has a transfer belt the back surface of which is supported by a metal backup roller. The three primary colored toner images formed on the photoconductor belt are transferred onto the transfer belt in such a way that the images are superimposed with one another. A metal transfer roller to which a predetermined transfer voltage is applied is disposed opposite to the backup roller across the transfer belt. Copy paper is transported between the transfer roller and the transfer belt onto which the toner image has been transferred, the transfer roller pressing the copy paper against the backup roller with the transfer belt placed therebetween, while an electric field necessary for the toner image on the transfer belt to be transferred is created by the voltage applied to the transfer roller, thus transferring the toner image from the transfer belt onto the copy paper.

In the above mentioned transfer unit, since the backup roller is made of metal, the voltage applied to the transfer roller causes current to flow between the two rollers, thus creating an electric field. Since an electric field necessary for transferring a toner image is created between the two rollers, a relatively high voltage is required to form an electric field necessary for transferring a toner image, resulting in a larger total current flowing between the transfer roller and the backup roller. As a result, when no copy paper exits between the two rollers, or depending on the kind of copy paper when copy paper does exits between the two rollers, there arises a possibility of the transfer belt suffering a dielectric breakdown. Also, depending on the change in the environment surrounding the transfer unit, e.g., change of temperature, humidity, etc., the total current required to form an electric field necessary for transferring a toner image may substantially wander, resulting in the inconsistency of the quality of the toner image transferred to the copy paper.

SUMMARY OF THE INVENTION

The transfer unit of this invention, which overcomes the above-discussed and numerous other disadvantages and deficiencies of the prior art, comprises a transfer belt onto which toner images are formed; a backup roller on which said transfer belt is applied, the metallic surface of said backup roller being coated with a dielectric film;

a metallic transfer roller that is disposed opposite to said backup roller across said transfer belt and to which a predetermined transfer voltage is applied, said transfer roller pressing copy paper against said backup roller with said transfer belt placed therebetween so that said toner images formed on said transfer belt are transferred onto said copy paper to be transported between said transfer roller and said transfer belt; and a back plate that is located in the vicinity of said backup roller and that contacts the back surface of said transfer belt.

In a preferred embodiment, the transfer unit further comprises a discharge brush that is disposed adjacent to said backup roller in a manner to contact the dielectric film of said backup roller so as to remove electric charge given to the surface of said dielectric film.

In a preferred embodiment, the dielectric film is made of polyethylene terephthalate and said transfer voltage applied to said transfer roller is in the range of about 1.5 to 3.5 kV.

In a preferred embodiment, the dielectric film is made of polycarbonate and said transfer voltage applied to said transfer roller is in the range of about 0.8 to 1.0 kV.

In a preferred embodiment, the transfer roller is disposed slidably toward said backup roller so that it comes into contact with and separates from said backup roller.

Thus, the invention described herein makes possible the objectives of (1) providing a transfer unit in which a dielectric film is formed on the surface of the backup roller, and the transfer voltage applied to the transfer roller causes the current to flow along the transfer belt to a back plate disposed adjacent to the backup roller, so that an electric field for transferring a toner image by a low transfer voltage can be created, thereby protecting the transfer belt from dielectric breakdown; (2) providing a transfer unit in which it is possible to prevent the total current required to create an electric field necessary for transferring a toner image from wandering depending on the kind of copy paper used, the presence and absence of copy paper between the two rollers, the change in the environment surrounding the transfer unit, and other factors, which makes it possible to enhance the quality of the toner image transferred to the copy paper; and (3) providing a transfer unit in which since the electric charge given to the surface of the dielectric film covering the backup roller is removed by a discharge so that there is no possibility of a potential difference being created on the surface of the dielectric film, so that the strength of the electric field created for transferring a toner image can be maintained at a fixed level, resulting in the enhancement of the quality of the toner image transferred to the copy paper.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
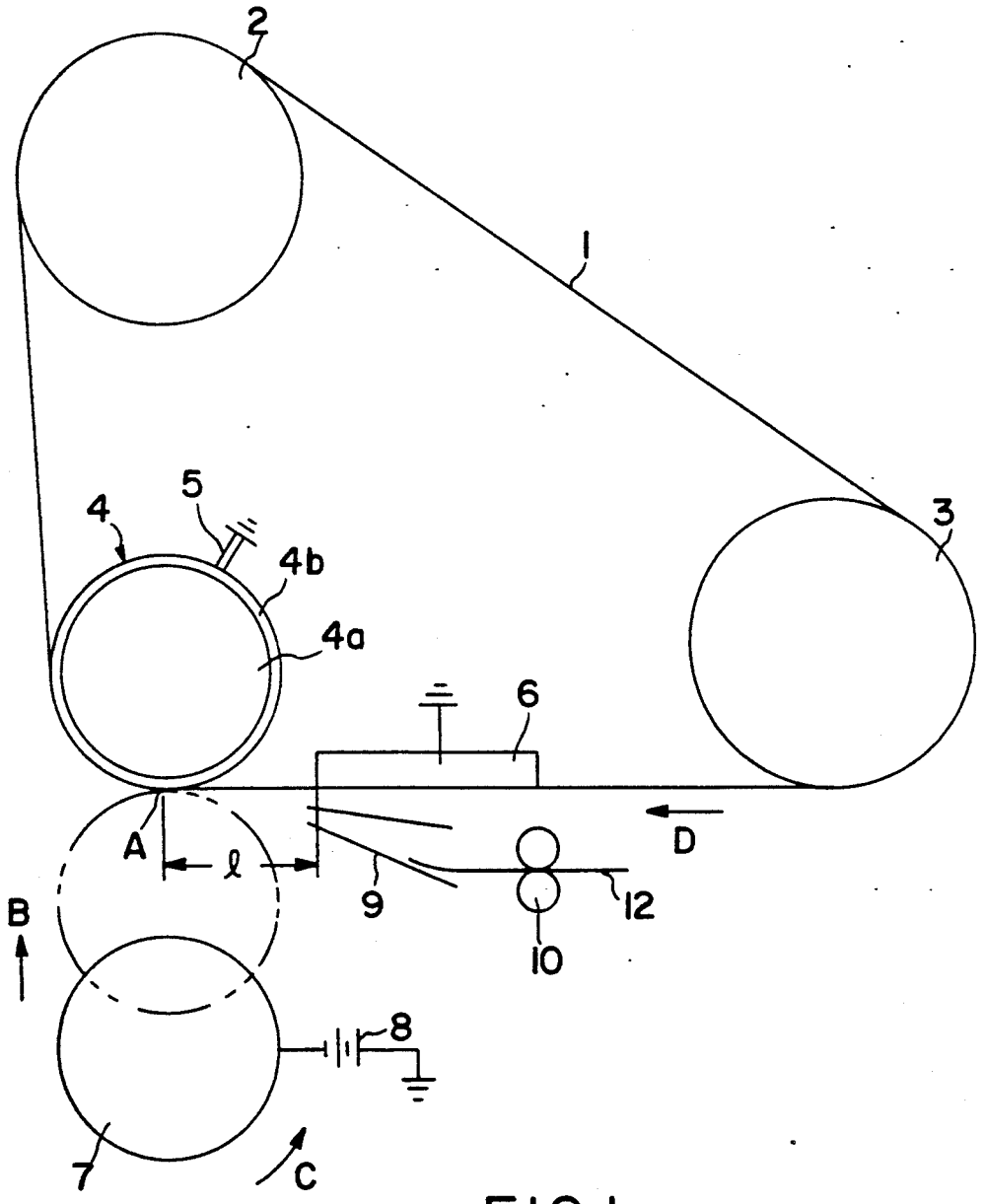
FIG. 1 is a schematic diagram showing a transfer unit of this invention.

FIG. 1 shows a transfer unit of this invention comprises a transfer belt 1 which is applied on a driving roller 2, a driven roller 3 and a backup roller 4. The transfer belt 1 is continuously movable on the rollers 2-4. Images formed with toner of three primary colors, yellow, magenta, and cyan, are transferred from a photoconductor belt (not shown) onto the transfer belt 1, the images being superimposed with one another on the specified area on the outer surface thereof. The transfer belt 1 with the toner images transferred on the outer surface thereof runs in a circular motion in the direction indicated by the arrow D in FIG. 1 from the driven roller 3 toward the backup roller 4.

The driving roller 2 is made, for example, of conductive rubber, the diameter being approximately 50 mm. The driven roller 3 is made, for example, of aluminum, the diameter being approximately 42 mm. The backup roller 4 comprises, for example, an aluminum roller 4*a* with a diameter of approximately 25 mm and a dielectric film 4*b* covering the surface of the roller 4*a*. The dielectric film 4*b* is formed, for example, of polycarbonate with a resistivity of approximately $10^5$–$10^6\Omega\cdot$cm and a thickness of approximately 500 μm. Alternatively, polyethylene terephthalate with a thickness of approximately 100 μm can be used for the dielectric film 4*b*.

Figure 2:
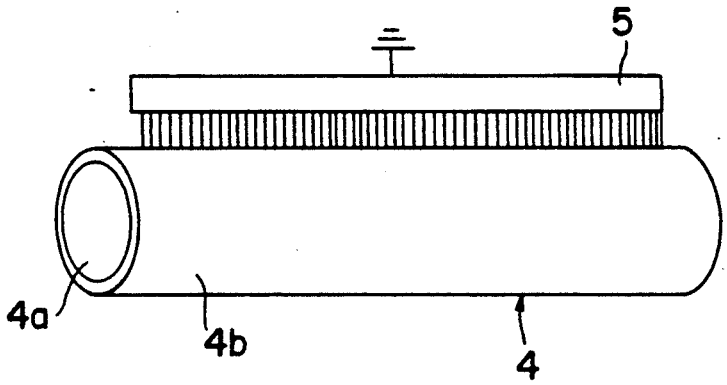
FIG. 2 is a perspective view showing a discharge brush of the transfer unit shown in FIG. 1.

A discharge brush 5 is disposed adjacent to the backup roller 4 in a manner to contact the dielectric film 4*b* formed on the surface thereof. As shown in FIG. 2, the discharge brush 5 is so constructed as to contact the dielectric film 4*b* of the backup roller 4 practically over the entire axial length thereof. The discharge brush 5 is grounded and removes the electric charge given to the surface of the dielectric film 4*b*. Electric charge is therefore prevented from building up on the surface of the dielectric film 4*b*, eliminating the possibility of a potential difference being created on the surface of the dielectric film 4*b*.

A transfer roller 7 is disposed opposite to the backup roller 4 across the transfer belt 1. The transfer roller 7 is movable in the direction indicated by the arrow B in FIG. 1 as well as in the reverse direction thereof so that the transfer roller 7 can come into contact with and separate from the backup roller 4. The transfer roller 7 is also rotatable in the direction indicated by the arrow C. By being moved in the direction of the arrow B toward the backup roller 4, the transfer roller 7 is press contacted onto the transfer belt 1. A predetermined transfer voltage is applied to the transfer roller 7 by a voltage supply 8.

Figure 3:
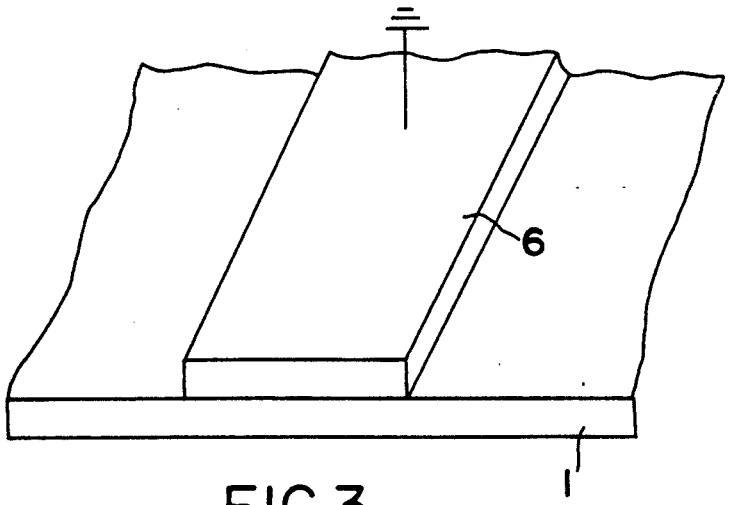
FIG. 3 is a perspective view showing a back plate of the transfer unit shown in FIG. 1.

Interposed between the backup roller 4 and the driven roller 3, and located nearer to the backup roller 4, is a back plate 6 which contacts the back surface of the transfer belt 1 as shown in FIG. 3. The back plate 6 is disposed, for example, at a distance 1 away from a point A where the transfer roller 7 is pressed against the backup roller 4 with the transfer belt 1 placed therebetween. The back plate 6 is formed, for example, of stainless steel and is grounded.

The distance 1 from the back plate 6 to the point A on the backup roller 4 is generally set at 10–18 mm when polycarbonate is used for the dielectric film 4*b* of the backup roller 4, and at 5–25 mm when polyethylene terephthalate is used.

Disposed outwardly of the portion of the transfer belt 1 facing the back plate 6 is a paper guide 9 for guiding copy paper 12 that is to be transported along the transfer belt 1. At the side of the paper guide 9 nearer to the driven roller 3 are disposed paper feed rollers 10 for feeding the copy paper 12 into the paper guide 9. The copy paper 12 fed into the paper guide 9 passes through the paper guide 9 and is fed between the transfer roller 7 and the transfer belt 1 applied on the backup roller 4.

The above-mentioned transfer unit is used for a full color copying machine. In the full color copying machine, toner images of primary three colors, yellow, magenta, and cyan, are formed on different areas on the photoconductor belt. The toner images are transferred, being superimposed with one another, onto the specified area on the outer surface of the transfer belt 1 in the transfer unit.

When the area of the transfer belt 1 on which the toner image is transferred reaches a position between the driven roller 3 and the backup roller 4, the copy paper 12 is fed by the paper feed rollers 10 into the paper guide 9 at a predetermined timing. The copy paper 12 is transported so that when the toner image area on the transfer belt 1 reaches the point A where the backup roller 4 faces the transfer roller 7 across the transfer belt 1, the copy paper 12 also reaches the point A. As the toner image area on the transfer belt 1 and the copy paper 12 reach the point A, the transfer roller 7 rotatable in the direction of the arrow C in FIG. 1 is moved in the direction of the arrow B toward the backup roller 4. The transfer roller 7 is then press contacted onto the transfer paper 12, for example, with a force of about 2–3 kg, thus press contacting the transfer paper 12 with the toner image on the transfer belt 1. At this time, a predetermined transfer voltage is applied to the transfer roller 7, causing the toner image on the transfer belt 1 to be transferred onto the copy paper 12.

Since the backup roller 4 disposed opposite to the transfer roller 7 across the transfer belt 1 is provided with the dielectric film 4*b* on the surface thereof and the back plate 6 is disposed adjacent to the backup roller 4, the current to create an electric field by the transfer voltage applied to the transfer roller 7 flows along the transfer belt 1 to the back plate 6. Because part of the electric field is created by the current flowing along the transfer belt 1, it is possible to create an electric field for transferring the toner image on the transfer belt 1 onto the transfer paper 12 by a low voltage. A conventional transfer unit using a backup roller with no dielectric film disposed on its surface generally requires a transfer voltage in the range of 7–9 kV, whereas in the transfer unit of this invention using the backup roller 4 with the dielectric film 4*b* formed of polyethylene terephthalate, the transfer voltage is generally set in the range of as low as about 1.5–3.5 kV depending on the variations in the environment surrounding the transfer unit and other factors. In the case of the transfer unit of this invention using the backup roller 4 with the dielectric film 4*b* formed of polycarbonate, the transfer voltage is generally set in the range of 0.8–1.0 kV.

Thus, in the transfer unit of this invention, the transfer voltage is set at a low level, and furthermore, the current to create an electric field for transferring a toner image is made to flow along the transfer belt 1, thereby preventing the total current required for creating the electric field from wandering depending on the transportation state of copy paper, the kind of copy paper used, or other factors.

Also, since the electric charge given to the surface of the dielectric film 4*b* of the backup roller 4 is removed by the discharge brush 5, no potential difference is created on the surface of the dielectric film 4*b*, thereby enhancing the quality of the toner image transferred to the copy paper.

In the above embodiment, polyethylene terephthalate or polycarbonate is used for the dielectric film 4*b* of the backup roller 4. Alternatively, silicon rubber or the like with a resistivity of $10^{12}$–$10^{14}\Omega\cdot$cm can be used.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A transfer unit comprising:

a transfer belt onto which toner images are transferred from a photosensitive means; a backup roller on which said transfer belt is applied, said backup roller having a metallic surface coated with dielectric film;

a metallic transfer roller disposed opposite to said backup roller across said transfer bolt and to which a transfer voltage is applied, said transfer roller pressing copy paper against said backup roller with said transfer belt placed therebetween so that said toner images carried on said transfer belt are transferred onto said copy paper running between said transfer roller and said transfer belt;

a back plate located adjacent said backup roller and kept in contact with the back surface of said transfer belt; and wherein said dielectric film is made of polyethylene terephthalate and said transfer voltage applied to said transfer roller is in the range of about 1.5 to 3.5 kV.

2. A transfer unit comprising;

a transfer belt onto which toner images are transferred from a photosensitive means; a backup roller on which said transfer belt is applied, said backup roller having a metallic surface coated with dielectric film;

a metallic transfer roller disposed opposite to said backup roller across said transfer belt and to which a transfer voltage is applied, said transfer roller pressing copy paper against said backup roller with said transfer belt placed therebetween so that said toner images carried on said transfer belt are transferred onto said copy paper running between said transfer roller and said transfer belt;

a back plate located adjacent said backup roller and kept in contact with the back surface of said transfer belt; and wherein said dielectric film is made of polycarbonate and said transfer voltage applied to said transfer roller is in the range of about 0.8 to 1.0 kV.

* * * * *